United States Patent [19]

Rempt

[11] Patent Number: 4,975,572

[45] Date of Patent: Dec. 4, 1990

[54] APPARATUS FOR PRODUCING A MONATOMIC BEAM OF GROUND-STATE ATOMS

[75] Inventor: Raymond D. Rempt, Woodinville, Wash.

[73] Assignee: The Boeing Company, Seattle, Wash.

[21] Appl. No.: 445,082

[22] Filed: Nov. 30, 1989

Related U.S. Application Data

[63] Continuation of Ser. No. 117,113, Nov. 4, 1987, abandoned.

[51] Int. Cl.[5] ..... H05H 3/02

[52] U.S. Cl. ..... 250/251; 250/398; 422/186; 422/186.04; 423/579; 423/644; 204/157.41

[58] Field of Search ..... 204/157.41; 250/251, 250/398; 422/186, 186.04; 423/579, 644

[56] References Cited

U.S. PATENT DOCUMENTS

| | | | |
|---|---|---|---|
| 3,766,396 | 10/1973 | Kruger et al. | 250/427 |
| 3,992,625 | 11/1976 | Schmidt et al. | 250/284 |
| 4,140,576 | 2/1979 | Fink et al. | 176/1 |
| 4,140,577 | 2/1979 | Fink et al. | 250/251 |
| 4,264,819 | 4/1981 | Astley et al. | 250/423 P |
| 4,327,288 | 4/1982 | Ashkin et al. | 250/251 |
| 4,434,131 | 2/1984 | Dagenhart et al. | 376/130 |
| 4,480,185 | 10/1984 | Hashimoto | 250/251 |
| 4,596,687 | 6/1986 | Dagenhart | 376/130 |
| 4,649,273 | 3/1987 | Chutjian et al. | 250/251 |
| 4,649,278 | 3/1987 | Chutjian et al. | 250/423 R |
| 4,686,022 | 8/1987 | Rempt | 204/157.41 |
| 4,734,579 | 3/1988 | Lucatorto et al. | 250/282 |

OTHER PUBLICATIONS

Hecht, *The Laser Guidebook*, 1986, pp. 2,23,24,25,26,27.

*Primary Examiner*—T. Tung
*Assistant Examiner*—David G. Ryser
*Attorney, Agent, or Firm*—Mary Y. Redman

[57] ABSTRACT

An electron beam is directed into a first region containing gaseous molecules which capture electrons from the beam and then dissociate to produce negative ions. The ions are accelerated to the desired energy electrostatically and drawn to a second region where they are exposed to an intra-cavity laser beam which traverses their path. The laser is chosen to have a wavelength which will cause photodetachment of electrons to form neutral atoms. Simultaneously with the above, the electron beam and ions are collimated with a magnetic field. The neutral atoms are separated from any remaining ions or electrons by a repelling electrical potential provided by a repeller plate or the like.

15 Claims, 1 Drawing Sheet

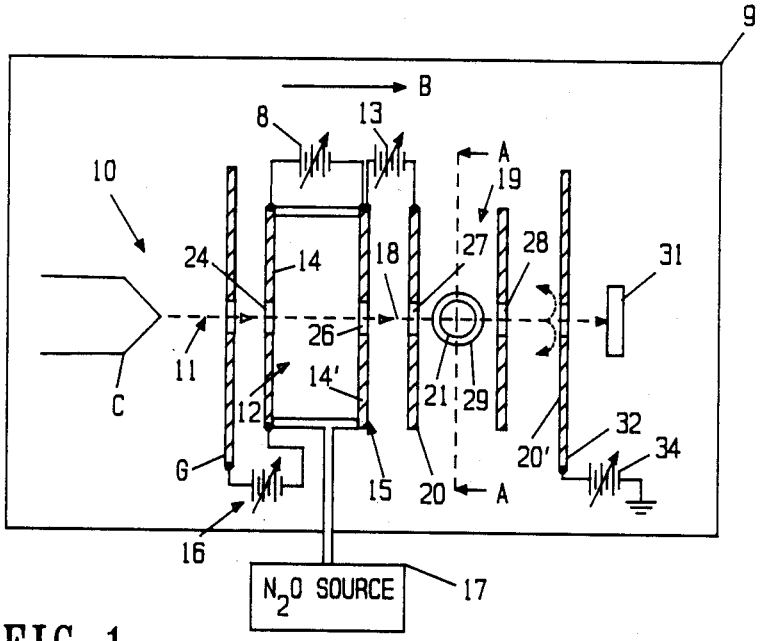
FIG.1
FIG.2
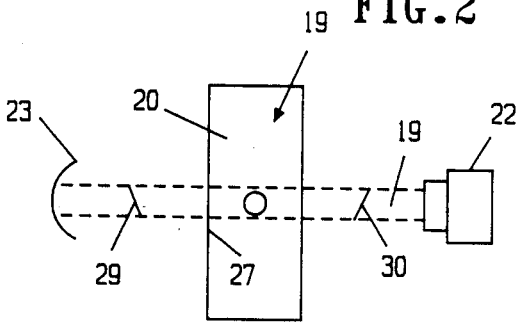
FIG.3
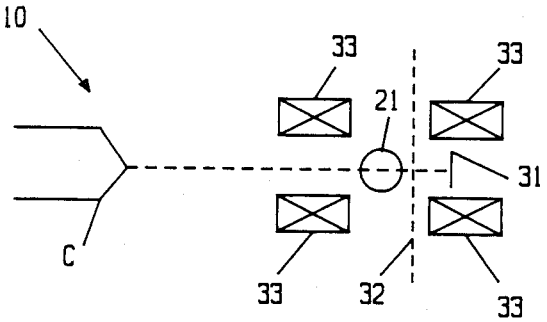

APPARATUS FOR PRODUCING A MONATOMIC BEAM OF GROUND-STATE ATOMS

This is a continuation of copending application serial number 07/117,113 filed Nov. 4, 1987.

BACKGROUND OF THE INVENTION

This invention relates to the production of a monatomic beam of a particular element and, more particularly, to the production of a monatomic beam of oxygen produced by photodetachment of electrons from oxygen ions in the presence of a magnetic field.

In certain test environments it is desirable to produce a beam of atoms of a particular element that are neutral in charge and in the ground state. One example of such a situation is in the research surrounding the provision of spacecraft in low earth orbit. In order to test the reaction of materials to be utilized in the space station, it is necessary to simulate the atmospheric conditions at a height of 200 to 600 kilometers, which is typical low earth orbit altitude. It has been found by previous experiments that the atmosphere at such an altitude is comprised of essentially neutral atomic oxygen with an equivalent flux of approximately $10^{15}$ atoms/cm$^2$/second due to the orbital velocity at that altitude, which corresponds to an energy of about 5 electron volts. Previous attempts to produce neutral atomic oxygen beams have produced either beams of the required energy but with low flux rates, or beams with the required flux rate but with low energy. In either case, the beams are impure and sometimes ionic.

Many problems have arisen in previous attempts to produce neutral atomic oxygen beams in the five to eight electron volt energy, and $10^{15}$ atoms/cm$^2$/second flux range. Past attempts have often been based on heating molecular gases to extremely high temperatures to obtain neutral atoms with high translational velocities in order to achieve energies of five electron volts. However, this procedure results in high percentages of ionized species and also a high percentage of undesired excited-state species, which are not present at low earth orbital altitudes and which will react differently than the neutral species that are present at such altitudes. The ionized species can be filtered out at the exit plane of the beam apparatus to leave only the neutral atoms. This, however, results in a severe loss of flux. Removing the undesired excited species is even more difficult and has been performed by quenching the excited states, using a proper mixture of inert foreign gases, such as argon or krypton. The quenching procedure, however, results in an impure beam and a loss of kinetic energy of the ground-state species.

Another problem of prior art devices is the spatial divergence of the atomic oxygen beam. A magnetic field parallel to the path of an electron or ion beam can be used to collimate that beam, and will impart a spiraling motion to the charged particles within the beam. When neutral atoms are formed from spiraling ions, these neutral particles will tend to spiral outward. The magnetic field, however, will be useless in limiting the motion of neutral particles. Thus, the resulting beam which contains neutral atoms will be subject to spatial divergence, which is often referred to as "beam blowup".

Although generation of a beam of atoms in the ground state has been discussed thus far, the ability to produce a beam of atoms in a selected excited state, as well as in the ground state, would be a useful characteristic of a monatomic beam generator, increasing the scope of scientific investigation for which the beam generator could be used.

It is, therefore, an object of the present invention to provide a method and apparatus to produce a beam of atomic oxygen of neutral charge in which substantially all of the atoms are at the ground state and to provide such a beam of energy and flux density that simulates the atmospheric conditions at low earth orbital altitudes.

It is another object of this invention to provide a method and apparatus for producing monatomic beams of other elements in which the atoms are at the ground state and are of a predetermined energy.

It is still another object of the invention to direct a monatomic beam of oxygen or other elements to the desired target or collection device in such a manner that spatial divergence of the beam is avoided or minimized.

It is still another object of the invention to selectively produce a beam of atoms in a desired excited state, as well as in the ground state.

SUMMARY OF THE INVENTION

To accomplish the objects discussed above, the claimed invention utilizes the process of electron capture by particular molecules, followed by dissociation of the charged molecule into components, one of which is the negative ion of the desired element. In a preferred embodiment, an electron beam is directed into a first region containing gaseous molecules. The molecules capture electrons from the beam and then dissociate to produce negative ions. The type of molecules is chosen so that the ions which are formed are ions of the particular element desired for the monatomic beam. The ions are accelerated to the desired energy electrostatically and drawn to a second region where they are exposed to an intra-cavity laser beam which traverses their path. The laser beam is chosen to have a wavelength which will cause photodetachment of electrons to form neutral atoms. Because a very high photon flux is obtainable within a laser cavity, a high flux of the desired atoms is attainable when the laser beam is used in an intra-cavity fashion. Simultaneously with the above, the electron beam and ions are collimated with a magnetic field.

The neutral atoms are separated from any remaining ions or electrons by a repelling electrical potential provided by means such as a repeller plate or grid mounted transverse to the beam and carrying an appropriate electrical potential. Thus, charged particles are turned back while the neutral atoms travel on to the target. This technique is highly advantageous in that the path length traversed by the neutral atom beam is minimized, which minimizes beam divergence.

As an example of one particular embodiment of the invention, in the production of a neutral atomic oxygen beam, an electron beam collimated by a magnetic field is introduced into a nitrous oxide ($N_2O$) environment, which is at a pressure near vacuum; for example, in the range of $10^{-4}$ to $10^{-2}$ Torr. The electrons will attach themselves to the $N_2O$ molecules, which will then naturally dissociate according to the following reaction:

$$e + N_2O \rightarrow N_2O^-$$

$$N_2O^- \rightarrow N_2 + O^-$$

The beam of negative oxygen ions ($O^-$) is collimated by a magnetic field and after acceleration to the desired energy, is presented to a laser with a wavelength that is slightly shorter than the wavelength corresponding to the electron affinity of the oxygen atom. Upon exposure to the laser beam a fraction of the negative oxygen ions experience photodetachment of the excess electron producing neutral oxygen atoms. If it is desired to produce a beam of oxygen atoms in the first excited state, a laser of a wavelength below 0.36 microns is used, causing the following reaction:

$$O^- + h\nu \rightarrow O^*(^1D) + e^-$$

An electrical field created by a repeller plate held at an appropriate potential turns negative oxygen ions and electrons away while the photodetached neutral oxygen atoms proceed to a target or collection area, depending upon the use of the neutral atomic oxygen beam. Other neutral atomic element beams can be produced utilizing different reactions and different wavelength lasers.

BRIEF DESCRIPTION OF THE DRAWINGS

FIG. 1 is a schematic representation of an apparatus according to a first embodiment of the invention;

FIG. 2 is a cross-section taken along line A—A of FIG. 1, and;

FIG. 3 is a schematic view of an apparatus according to a second embodiment of the invention.

DETAILED DESCRIPTION OF THE PREFERRED EMBODIMENT

The following discussion will set forth the principles of the present invention as utilized in a preferred embodiment to produce a beam of neutral oxygen atoms in the ground state. It will, however, be realized by those of ordinary skill in the art that the particular reactions discussed and the beam produced are exemplary only and other reactions can be used to produce beams of other elements in the ground state or chosen excited states, as will be discussed later.

Referring to FIG. 1, an electron gun 10 includes a heated cathode C and grid G held at a suitable potential to accelerate the electrons. The cathode C may be indirectly heated so that electrons come off with a smaller energy spread than in a conventional, directly heated "hair pin" filament. The cathode C emits a stream of electrons 11 through the grid G and into an ionization region 12 within a vacuum chamber 9. The ionization region 12 is usually isolated from the surrounding environment to preclude the effects of the higher pressure ($10^{-4}$–$10^{-2}$ Torr) of target molecules on the cathode. The isolation may be accomplished by provision of a cavity 15 which includes conductive first and second walls 14, 14' with apertures 24, 26, respectively, through which the beam may enter and exit. A small positive potential is applied between the two walls 14 and 14' by a voltage source 8 to accelerate the ions toward the detachment region, which is discussed below.

$N_2O$ flows into the ionization region 12 from an $N_2O$ source 17 outside of the vacuum chamber 9, and is typically maintained at a pressure of about 1 to 5 microns. The ionization region 12 is electrically biased so that the energy of the electrons within that region is substantially coincident with the attachment energy peak of $N_2O$, which is about 2.2 electron volts. A variable voltage source 16 coupled to the first wall 14 of the ionization region 12 can produce such a bias.

The process of resonant dissociative attachment takes place in the ionization region 12. At an energy level of about 2.2 electron volts, the electrons will attach to the $N_2O$ molecules which will then naturally dissociate in a short span of time, yielding neutral nitrogen molecules ($N_2$) and negatively charged oxygen ions ($O^-$). The stream of neutral particles and negatively charged oxygen ions and electrons 18 exits the ionization region 12 and enters a detachment region 19 which may be defined by two parallel plates 20, 20' with apertures 27, 28, respectively, within the vacuum chamber and perpendicular to the line of travel of the ion and electron beam 18.

Apertures 27, 28 in the plate 20, 20' provide an entryway and exit for the beam and screen the region from the repeller potential downstream (discussed below). The detachment region 19 is biased, preferably by a voltage source 13 which establishes the energy of the ions. This voltage source is variable and hence provides for energy selection of the ions and ultimately the neutral atomic beam.

The biasing voltage may be selected as desired for a particular application. To approximate the effects of low earth orbit, a bias of about 5 electron volts is appropriate. A laser beam 21 is introduced to the detachment region 19, traveling perpendicular to the beam 18. To maximize the incidence of photodetachment, the interaction between the laser beam 21 and ions should occur as an intracavity interaction, i.e., the region of interaction should be a part of the gain medium of the laser. This means that the interaction occurs within a laser cavity, where a very high photon flux is obtainable. Thus, as shown in FIG. 2, a laser source 22 and a mirror 23 are placed at opposite sides of the detachment region 19, with a pair of Brewster's angle windows 29, 30 suitably mounted therebetween. This arrangement yields a high efficiency, since a very high percentage of all photons leaving the laser beam source 22 will traverse the beam 18.

In a preferred embodiment, the laser source 22 is chosen so that the resulting laser beam will have a wave length slightly shorter than that corresponding to the electron affinity of the oxygen atom (approximately 0.75 microns). A portion of the negative oxygen ions will experience photodetachment of the excess electrons, thereby producing neutrally charged oxygen atoms.

The fast beam 18 (which now contains neutral oxygen atoms, electrons, and some ions) exits the detachment region 19 and then meets a repeller plate 32. The repeller plate 32 is held at a suitable potential by a voltage source 34 to repel ions and electrons, thereby assuring that only neutral oxygen atoms (and some $N_2$ and $N_2O$ molecules at thermal speed) progress through an aperture in the plate to reach the target 31. Preferably, the repeller plate 32 is mounted perpendicular to the beam path, and is placed as close to the detachment region 19 as possible. The target 31 is, in turn, mounted as close to the repeller plate as possible. The use of a repeller plate so positioned is highly advantageous in preventing what is commonly called "beam blow up," the tendency of a beam of spiraling charged particles to diverge in space upon neutralization. By utilizing a repelling electric field, the flight path of the neutral particles can be made as short as possible, thus minimizing divergence of the neutral atomic oxygen beam. It is possible to place the target within ten inches of the electron gun, and within five and one-half inches of the laser beam, in a preferred embodiment of the invention.

The magnetic field used to collimate the ion beam 18 is provided by appropriate superconducting electrical coils connected to a power source in a manner which will be apparent to those skilled in the art. A magnetic field strength of approximately 70,000 gauss has been found to be acceptable for collimating the ion beam.

Referring now to FIG. 3, it is highly advantageous to place the electron gun 10 remote from the magnetic poles 33, at a point where the magnetic field is significantly reduced, so as to reduce stress on the high current filament, and also to reduce the heat rejection requirements for the cryogenic dewar which houses the superconducting magnetic poles. A distance of about four to six inches from the end of the coils has been found to be acceptable for this purpose.

As discussed above, the disclosed reaction of the electron capture with nitrous oxide and subsequent dissociation to form oxygen ions is only one of many reactions that can be utilized with the apparatus of the present invention to produce monatomic beams of particles. For example, if the production of oxygen atoms in the first excited state is desired, a laser of wavelength less than 0.36 microns is used. This causes the reaction:

$$O^- + \nu \rightarrow O^*(^1D) + e^-.$$

Other excited states could be produced by use of the appropriate wavelengths.

In another variation, in order to produce a beam of atomic hydrogen, the ionization region 12 would contain $H_2$ molecules that would then interact with the electron from the cathode C to form hydrogen atoms and hydrogen ions. In this case, the energy of the electrons emitted by the cathode would be predetermined to approximately 13.95 electron volts in order to cause the reaction:

$$e^- + H_2 \rightarrow H + H^-$$

The negative hydrogen ions could then be drawn into the detachment region 17 for exposure to the laser, which, in this case, would have a wavelength of less than 1.646 microns in order to photodetach the electron from the hydrogen ion to produce neutral hydrogen atoms. Any hydrogen ions from which the electron did not photodetach will be repelled by the potential on the repeller plate 32. As will be understood by those of ordinary skill in the art, other elemental atomic beams can be produced. The method and apparatus of the present invention can also be utilized to produce beams of several radicals, such as $OH^-$, $NO^-$, $CH^-$ and others. Of course, the reactions to produce these beams will all be different from those described above; however, they are within the scope of knowledge of the persons skilled in the art. Also, the energy of the electron beam produced by the cathode and the wavelength of the laser beam will have to be varied in accordance with the reaction to be produced. It is important to remember that if ground state atoms are desired, the wavelength of the laser beam must be such that the laser has sufficient energy to detach the electrons as required but not to excite the atoms from the ground state.

While a preferred embodiment of the invention has been described and illustrated herein, it will be understood by those of ordinary skill in the art and others that changes can be made to the illustrated and described embodiment while remaining within the scope of the present invention.

What is claimed is:

1. An apparatus for producing a beam of neutral atoms directed toward a target comprising;

means for producing an electron beam and directing said electron beam along a substantially linear path directed toward the target;

means defining a first region containing molecules of a gas and lying on said path, whereby said electron beam will interact with said molecules and negative ions will be formed;

means for providing a laser beam, including a laser cavity which contains a gain medium;

means defining a second region lying on said path in which said laser beam traversing said path will interact with said ions, said second region lying within the gain medium of said laser beam, whereby said laser beam will interact with said ions and neutral atoms will be formed; and means for repelling said electrons and said ions away from said target, said repelling means including a conductive plate mounted transverse to said path adjacent said second region and substantially immediately before the target, and having an electrical potential sufficient to repel said electrons and said ions away from said plate.

2. The apparatus of claim 1 further comprising means for electrically biasing said first and second regions, such that the energy of said electrons in said first region substantially coincides with the peak energy for electron attachment of said molecules, and the energy of said ions in said second region substantially coincides with a desired energy.

3. The apparatus of claim 1 further comprising means for generating a magnetic field parallel to said path, whereby divergence of electrons and ions form said path is minimized.

4. An apparatus for producing a beam of neutral atoms comprising:

means for producing a beam of electrons traveling along a substantially linear path;

means defining a first region located on said path downstream from said electron beam producing means;

a source of gaseous molecules in communication with said first region whereby said molecules will enter said first region;

biasing means for electrically biasing said first region so that the energy of said electrons within said first region is substantially coincident with the attachment energy peak of said molecules, whereby said electron beam will interact with said molecules within said first region to form negative ions;

means for accelerating said ions along said path in the direction of travel of said electron beam;

laser beam source means located downstream of said first region and including a laser cavity which intersects said path, the area of intersection defining a second region in which a laser beam from said laser beam source means will interact with said negative ions to form neutral atoms;

magnetic field generating means for producing a magnetic field parallel to said path, whereby divergence of said electrons and ions from said path is inhibited; and means for changing the direction of travel of said electrons and ions downstream from said laser beam source means.

5. The apparatus of claim 4 wherein said direction changing means includes an electrically conductive plate mounted perpendicular to said path and held at an electrical potential sufficient to repel said electrons and said ions, said plate having an aperture therethrough which said path extends.

6. The apparatus of claim 5 wherein said accelerating means includes a pair of conductive walls perpendicular to said path and positioned at the upstream and downstream ends of said first region, said plates having apertures therethrough which said beam and ions can pass, and having an electrical potential therebetween sufficient to accelerate said ions.

7. The apparatus of claim 6 wherein said molecules are $N_2O$ molecules.

8. The apparatus of claim 6 wherein said molecules are $H_2$ molecules.

9. The apparatus of claim 5 further comprising a second biasing means for biasing said second region whereby the energy level of said ions will be determined by the bias applied to said second region.

10. The apparatus of claim 9 wherein said second biasing means includes means for applying a selectively variable bias, whereby the energy level of ions may be selectively varied.

11. The apparatus of claim 4 wherein said accelerating means includes a pair of conductive walls perpendicular to said path and positioned at the upstream and downstream ends of said first region, said plates having apertures therethrough which said beam and ions can.

12. The apparatus of claim 11 wherein said molecules are $N_2O$ molecules.

13. The apparatus of claim 11 wherein said molecules are $H_2$ molecules.

14. The apparatus of claim 4 further comprising a second biasing means for biasing said second region whereby the energy level of said ions will be determined by the bias applied to said second region.

15. The apparatus of claim 14 wherein said second biasing means includes means for applying a selectively variable bias, whereby the energy level of ions may be selectively varied.

* * * * *